US007894610B2

(12) United States Patent
Schmidt et al.

(10) Patent No.: US 7,894,610 B2
(45) Date of Patent: Feb. 22, 2011

(54) METHOD FOR CODING AND DECODING IMPULSE RESPONSES OF AUDIO SIGNALS

(75) Inventors: Jürgen Schmidt, Wunstorf (DE); Klaus Eilts-Grimm, Lüneburg (DE)

(73) Assignee: Thomson Licensing, Boulogne-Billancourt (FR)

( * ) Notice: Subject to any disclaimer, the term of this patent is extended or adjusted under 35 U.S.C. 154(b) by 408 days.

(21) Appl. No.: 10/581,107

(22) PCT Filed: Nov. 18, 2004

(86) PCT No.: PCT/EP2004/013123

§ 371 (c)(1),
(2), (4) Date: May 31, 2006

(87) PCT Pub. No.: WO2005/055193

PCT Pub. Date: Jun. 16, 2005

(65) Prior Publication Data

US 2007/0140501 A1 Jun. 21, 2007

(30) Foreign Application Priority Data

Dec. 2, 2003 (EP) ..... 03027638

(51) Int. Cl.
*H04R 5/00* (2006.01)

(52) U.S. Cl. ..... 381/17

(58) Field of Classification Search ..... 381/61, 381/63, 17, 18, 19, 309, 58, 59, 74, 77, 79, 381/80, 85

See application file for complete search history.

(56) References Cited

U.S. PATENT DOCUMENTS

| | | | | |
|---|---|---|---|---|
| 6,343,131 | B1 * | 1/2002 | Huopaniemi | 381/310 |
| 6,833,840 | B2 * | 12/2004 | Lifshitz | 345/630 |
| 6,959,096 | B2 * | 10/2005 | Boone et al. | 381/152 |
| 7,158,843 | B2 * | 1/2007 | Smith | 700/94 |
| 2003/0169887 | A1 | 9/2003 | Fujita et al. | |

OTHER PUBLICATIONS

Scheirer, Eric D. "Structured audio and effects processing in the MPEG-4 multimedia standard." Multimedia Sytems 7 (1999): 11-22.*

Koenen, Rob. Coding of Moving Pictures and Audio: MPEG-4 Overview (V.21—Jeju Version). Rep.No. ISO/IEC JTC1/SC29/WG11 N4668., International Organization for Standardization. Mar. 2002. 1-79.*

(Continued)

*Primary Examiner*—Vivian Chin
*Assistant Examiner*—Kile Blair
(74) *Attorney, Agent, or Firm*—Robert D. Shedd; Paul P. Kiel; Guy H. Eriksen

(57) ABSTRACT

The transmission and use of real, i. e. of measured, room impulse responses for the reproduction of sound signals with this room characteristic compatible to the MPEG-4 standard is made possible by inserting impulse responses in multiple successive control parameter fields, especially the params [128] array. A first control parameter field contains information about the number and content of the following fields. For presentation of the sound signals the content of the successive control parameter fields is separated, stored in an additional memory of a node and used during the calculation of the room characteristic.

9 Claims, 1 Drawing Sheet

OTHER PUBLICATIONS

Figure 1:
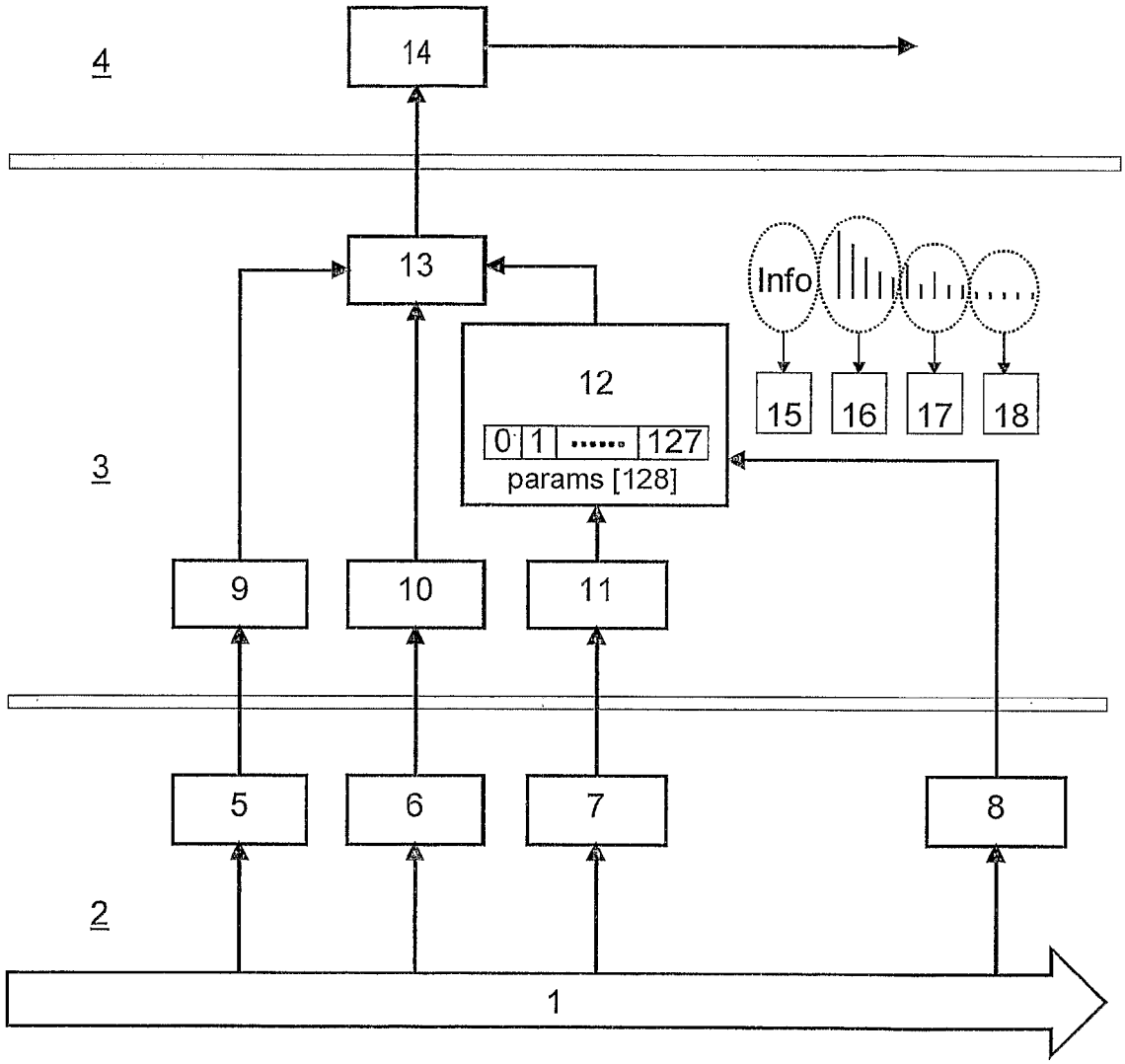

Juergen Schmidt, Oliver Baum: "A.1 Text of ISO/IEC 14496-11/FPDAM-3", International Organisation for Standardisation ISO-IEC JTC1-SC29-WG11 Coding of Moving Pictures and Audio, Mar. 2004, pp. 1-31, Munich, Germany.
E.D. Scheirer: "The MPEG-4 Structured Audio Standard" Acoustics, Speech and Signal Processing, 1998. Proceedings of the 1998 IEEE International Conference on Seattle, WA. USA, May 12-15, 1998, vol. 6, pp. 3801-3804.
J-M. Trivi et al.: Rendering MPEG-4 AABIFS content through a low-level cross-platform 3D audio api, IEEE Conference Proceedings of the ICME, Lausanne, vol. 1, Aug. 26, 2002, pp. 513-516.
Search Report Dated Feb. 15, 2005.

* cited by examiner

METHOD FOR CODING AND DECODING IMPULSE RESPONSES OF AUDIO SIGNALS

This application claims the benefit, under 35 U.S.C. §365 of International Application PCT/EP04/013123, filed Nov. 18, 2004, which was published in accordance with PCT Article 21(2) on Jun. 16, 2005 in English and which claims the benefit of European patent application No. 03027638.0, filed Dec. 2, 2003.

The invention relates to a method and to an apparatus for coding and decoding impulse responses of audio signals, especially for describing the presentation of sound sources encoded as audio objects according to the MPEG-4 Audio standard.

BACKGROUND

Natural reverberation, also abbreviated reverb, is the effect of gradual decay of sound resulting from reflections off surfaces in a confined room. The sound emanating from its source strikes wall surfaces and is reflected off them at various angles. Some of these reflections are perceived immediately while others continue being reflected off other surfaces until being perceived. Hard and massive surfaces reflect the sound with moderate attenuation, while softer surfaces absorb much of the sound, especially the high frequency components. The combination of room size, complexity, angle of the walls, nature of surfaces and room contents define the room's sound characteristics and thus the reverb.

Since reverb is a time-invariant effect, it can be recreated by applying a room impulse response to an audio signal either during recording or during playback. The room impulse response can be understood as a room's response to an instantaneous, all-frequency sound burst in the form of reverberation and typically looks like decaying noise. If a digitised room impulse response is available, digital signal processing allows adding an exact room characteristic to any digitized "dry" sound. Also it is possible to place an audio signal into different spaces just by utilizing different room impulse responses.

The transmission and use of real, i. e. of measured, room impulse responses for the reproduction of sound signals with this room characteristic has been the object of research and development in recent years. For using MPEG-4 as defined in the MPEG-4 Audio and Systems standard ISO/IEC 14496the transmission of long impulse responses turned out to be difficult due to the following problems:

1. Room impulse responses can be loaded into an MPEG-4 player as MPEG-4 'sample dumps', which is a technique that requires a full Structured Audio (SA, MPEG-4 audio programming language) implementation including MIDI with the appropriate MIDI and SA profiles. This solution has extreme high demands for code, complexity and execution power and, therefore, is nowadays impracticable for MPEG-4 players—and may even not be available in future devices.
2. Making use of synthetic room impulse responses by using the 'DirectiveSound' node, which is defined especially for Virtual Reality applications has the disadvantage that such parametric synthetic room impulse responses differ significantly from real measured room impulse responses and have a far less natural sound.
3. Adding a new node specifically designed for the transmission and use of real room impulse responses is undesired due to the above mentioned existing possible but not optimal solutions 1. and 2. and since the introduction of new nodes shall be avoided whenever possible.
4. Applying the same coding for the transmission of room impulse responses as for the audio signals itself is not reasonable. Typical MPEG audio encoding schemes take advantage of psychoacoustic phenomena, which are especially suited for reducing the audio data rate by suppressing unperceivable audio signal parts. However, since room impulse responses are related not to the human ear but to the rooms's characteristic applying psychoacoustics to room impulses would lead to falsifications.

INVENTION

The present invention is based on the object of specifying a method for coding impulse responses of audio signals, which is compatible to the MPEG-4 standard but nevertheless overcomes the above-mentioned problems. This object is achieved by the method specified in claim 1.

The invention is based on the recognition of the following fact. In the MPEG-4 Systems standard the so-called AudioFX node and the AudioFXProto solution are defined for describing audio effects. An array of 128 floating point values in the AudioFX node resp. AudioFXProto solution, called params [128], is used to provide parameters for the control of the audio effects. These parameters can be fixed for the duration of an effect or can be updated with every frame update e.g. to enable time dependent effects like fading etc. . . The use of the params[128] array as specified is limited to the transmission of a certain amount of control parameters per frame. The transmission of extended signals is not possible due to the limitation to 128 values, which is far too limited for extensive impulse responses.

Therefore, a method according to the invention for coding impulse responses of audio signals consists in the fact that an impulse response of a sound source is generated and parameters representing said generated impulse responses are inserted in multiple successive control parameter fields, especially successive params[128] arrays, wherein a first control parameter field contains information about the number and content of the following fields.

Furthermore, the present invention is based on the object of specifying a corresponding method for decoding impulse responses of audio signals. This object is achieved by the method specified in claim 6.

In principle, the method according to the invention for decoding impulse responses of audio signals consists in the fact that parameters representing impulse responses are separated from multiple successive control parameter fields, especially successive params[128] arrays, wherein a first control parameter field contains information about the number and content of the following fields. The separated parameters are stored in an additional memory of a node and the stored parameters are used during the calculation of the room characteristic.

Further advantageous embodiments of the invention result from the dependent claims, the following description and the drawing.

DRAWING

An exemplary embodiment of the invention is described on the basis of FIG. 1, which schematically shows an example BIFS scene with an AudioFXProto solution using successive control parameter fields according to the invention.

EXEMPLARY EMBODIMENT

The BIFS scene shown in FIG. 1 depicts an MPEG-4 binary stream 1 and three processing layers 2, 3, 4 of an MPEG-4 decoder. A Demux/Decode Layer 2 decodes three audio signal streams by feeding them to respective audio decoders 5, 6, 7, e.g. G723 or AAC decoder, and a BIFS stream by using a BIFS decoder 8. The decoded BIFS stream instantiates and configures the Audio BIFS Layer 3 and provides information for the signal processing inside the nodes in the Audio BIFS Layer 3 and also the above BIFS Layer 4. The decoded audio signal streams coming from decoders 5, 6, 7 serve as audio inputs for the Audio Source nodes 9, 10, and 11. The signal coming from Audio Source node 11 obtains an additional effect by applying a room impulse response in the AudioFXProto 12 before feeding the signals downmixed by AudioMix node 13 through the Sound2D node 14 to the output. Multiple successive params[128] fields, symbolized in the figure by successive blocks 15, 16, 17, 18, are used for the transmission of the complete room impulse response, wherein the first block 15 comprises general information like the number of the following params[128] fields containing the respective parts of the room impulse response. In the AudioFXProto implementation the complete room impulse response has to be recollected before the beginning of the signal processing.

In order to ease the understanding of this MPEG-4 specific embodiment, a brief explanation of the relevant MPEG-4 details are given below before going into further details of the inventive embodiment.

MPEG-4 facilitates a wide variety of applications by supporting the representation of audio objects. For the combination of the audio objects additional information—the so-called scene description—determines the placement in space and time and is transmitted together with the coded audio objects. After transmission, the audio objects are decoded separately and composed using-the scene description in order to prepare a single representation, which is then presented to the listener.

For efficiency, the MPEG-4 Systems standard ISO/IEC 14496 defines a way to encode the scene description in a binary representation, the so-called Binary Information for Scenes (BIFS). Correspondingly, a subset of it that is determined for audio processing is the so-called AudioBIFS. A scene description is structured hierarchically and can be represented as a graph, wherein leaf-nodes of the graph form the separate objects and the other nodes describes the processing, e.g. positioning, scaling, effects etc. . . The appearance and behaviour of the separate objects can be controlled using parameters within the scene description nodes.

The so-called AudioFX node is defined for describing audio effects based on the audio programming language "Structured Audio" (SA). Applying Structured Audio demands high processing power and requires a Structured Audio compiler or interpreter, which limits the application in products, where processing power and implementation complexity is restricted.

However, a simplification can be achieved by using the Proto mechanism defined in the MPEG 4 Systems Standard, which is a specific macro mechanism for the BIFS language. The AudioFXProto solution is taylored to consumer products and allows players without Structured Audio capability to use basic audio effects. The PROTO shall encapsulate the AudioFX node, so that enhanced MPEG 4 players with Structured Audio capability can decode the SA token streams directly. Simpler consumer players only identify the effects and start them from internal effect representations, if available. One field of the AudioFXProto solution is the params [128] field. This field usually contains parameters for the realtime control of an effect. The invention now uses multiple successive field updates for this params[128]-field, which is limited to a data block length of 128 floating point values (32 bit float), in order to make complex system parameter with a length greater that 128 floating point values, e.g. room impulse responses, usable in one effect. A first params[128]-field contains information about number and content of the following fields. This represents an extension of the field updates, which is—by default—performed with only one params[128]-field. The transmission of data of any length is made possible. These data can then be stored in an additional memory and can be used during the calculation of the effect. In principle, it is also possible to replace or amend, respectively, only certain parts of the field during operation, in order to keep the number of transmitted data a small as possible.

In detail, a special AudioFXProto for applying natural room impulse responses to MPEG-4 scenes, called audioNaturalReverb, contains the following parameters:

First params[ ] field:

| Data type | Function | Default | Range |
|---|---|---|---|
| float | NumParamsFields | 1 | 1 . . . 60000 |
| float | NumImpResp | 0 | 0 . . . 32 |
| float | SampleRate | | |
| float[ ] | ReverbChannels | 0 | 0, 1, 2, 3, . . . , 31 |
| float | ImpulseResponseCoding | 0 | 0 . . . 1 |
| . . . | | | reserved |

Following params[ ] fields:

| Data type | Function | Default | Range |
|---|---|---|---|
| float | impulseResponse-Length | 0 | 240000* |
| float[ ] | impulseResponse | | * |
| . . . | | | * numImpResp times |

The audioNaturalReverb PROTO uses the impulse responses of different sound channels to create a reverberation effect. Since these impulse responses can be very long (several seconds for a big church or hall), one params[ ] array is not sufficient to transmit the complete data set. Therefore, a bulk of consecutive params[ ] arrays is used in the following way:

The first block of params[ ] contains information about the following params[ ] fields:

The numParamsFields field determines the number of following params[ ] fields to be used. The NaturalReverb PROTO has to provide sufficient memory to store these fields.

The numImpResp defines the number of impulse responses.

The reverbChannels field defines the mapping of the impulse responses to the input channels.

The impulseResponseCoding field shows how the impulse response is coded (see table below).

| Coding value | Coding function |
|---|---|
| 0 | consecutive samples |
| 1 | sample-number/sample |

Case 1 can be useful to reduce the length of sparse impulse responses.

Additional values can be defined to enable a scalable transmission of the room impulse responses. One advantageous example in a broadcast mode could be to frequently transmit short versions of room impulse responses and to transmit less frequent a long sequence. Another advantageous example is an interleaved mode with frequent transmission of a first part of the room impulse responses and less frequent transmission with the later part of the room impulse responses.

The fields shall map to the first params[ ] array as follows:

numParamsFields=params [0]

numRevChan=params [1]

sampleRate=params [2]

reverbChannels [0 . . . numRevChan -1]=params [3 . . . 3+numRevChan-1]

impulseResponseCoding=params [3+numRevChan]

The following params[ ] fields contain the numImpResp consecutive impulse responses as follows:

The impulseResponseLength gives the length of the following impulseResponse.

The impulseResponseLength and the impulseResponse are repeated numImpResp times.

The fields shall map to the following params[ ] arrays as follows:

impulseResponseLength=params[0]

impulseResponse=params[1 . . . 1+impulseResponseLength]. . .

For calculating the reverberation according to the specified parameters different methods can be applied, resulting in a reverberated sound signal as output.

The invention allows a transmission and use of extensive room impulse responses for the reproduction of sound signals based on overcoming control parameter length limitations in the MPEG-4 standard. However, the invention can also be applied to other systems or other functions in the MPEG-4 standard having similar limitations.

The invention claimed is:

1. Method for coding impulse responses of audio signals, wherein said impulse responses allow reproduction of sound signals corresponding to a certain room characteristic, comprising:

using an MPEG-4 encoder to encode multiple successive MPEG-4 PROTO params fields of an MPEG-4 BIFS stream for transmission of one or more impulse responses associated with a coded audio signal as defined in the following steps:

inserting into a first of said multiple successive MPEG-4 PROTO params fields information about the following MPEG-4 PROTO params fields by said MPEG-4 encoder, wherein said information comprises a number of the following MPEG-4 PROTO params fields to be used and a number of impulse responses to be transmitted; and inserting into said following MPEG-4 PROTO params fields for each of said impulse responses a length information of the impulse response and samples representing the impulse response.

2. Method according to claim 1, wherein a scalable transmission of the room impulse responses is enabled.

3. Method according to claim 2, wherein in a broadcast mode short versions of room impulse responses are frequently transmitted and a long sequence is less frequently transmitted.

4. Method according to claim 2, wherein in an interleaved mode a first part of the room impulse responses is frequently transmitted and the later part of the room impulse responses is less frequently transmitted.

5. Method for decoding impulse responses of audio signals by an MPEG-4 decoder, wherein said impulse responses allow reproduction of sound signals corresponding to a certain room characteristic, comprising:

receiving, at an MPEG-4 decoder, one or more impulse responses in multiple successive MPEG-4 PROTO params fields of an MPEG-4 BIFS stream, wherein a first of said multiple successive MPEG-4 PROTO params fields includes information about the following MPEG-4 PROTO params fields, said information comprising a number of the following MPEG-4 PROTO params fields used and a number of impulse responses transmitted, and wherein said following MPEG-4 PROTO params fields include for each of said impulse responses a length information of the impulse response and samples representing the impulse response;

separating said samples representing said one or more impulse responses based on said information in said first MPEG-4 PROTO params field and said length information in said following MPEG-4 PROTO params fields by said MPEG-4 decoder;

and using said one or more impulse responses represented by said separated samples for calculation by said MPEG-4 decoder of a reverberation effect corresponding to said room characteristic.

6. Method according to claim 5, wherein the room impulse responses are received following a scalable transmission of said room impulse responses.

7. Method according to claim 6, wherein in a broadcast mode short versions of room impulse responses are frequently received and a long sequence is less frequently received.

8. Method according to claim 6, wherein in an interleaved mode a first part of the room impulse responses is frequently received and the later part of the room impulse responses is less frequently received.

9. Apparatus for coding impulse responses of audio signals, wherein the impulse responses allow reproduction of sound signals corresponding to a certain room characteristic, comprising;

an MPEG-4 encoder that encodes multiple successive MPEG-4 PROTO params fields of an MPEG-4 BIFS stream for transmission of one or more impulse responses associated with a coded audio signal, said MPEG-4 encoder inserts into a first of said multiple successive MPEG-4 PROTO params fields information about the following MPEG-4 PROTO params fields by said MPEG-4 encoder, wherein said information comprises a number of the following MPEG-4 PROTO params fields to be used and a number of impulse responses to be transmitted; and inserts into said following MPEG-4 PROTO params fields for each of said impulse responses a length information of the impulse response and samples representing the impulse response.

* * * * *